US011112162B2

(12) United States Patent
Hiller et al.

(10) Patent No.: US 11,112,162 B2
(45) Date of Patent: Sep. 7, 2021

(54) COLD ROOM COMBINATION VENT AND LIGHT

(71) Applicant: Kason Industries, Inc., Newnan, GA (US)

(72) Inventors: Raymond J Hiller, Newnan, GA (US); Brett A Mitchell, Newnan, GA (US); Burl M Finkelstein, Newnan, GA (US)

(73) Assignee: Kason Industries, Inc., Newnan, GA (US)

( * ) Notice: Subject to any disclaimer, the term of this patent is extended or adjusted under 35 U.S.C. 154(b) by 318 days.

(21) Appl. No.: 16/184,329

(22) Filed: Nov. 8, 2018

(65) Prior Publication Data

US 2019/0078827 A1 Mar. 14, 2019

Related U.S. Application Data

(63) Continuation-in-part of application No. 15/060,655, filed on Mar. 4, 2016, now abandoned.

(51) Int. Cl.

| | |
|---|---|
| ***F25D 13/00*** | (2006.01) |
| ***F25D 17/00*** | (2006.01) |
| ***F25D 27/00*** | (2006.01) |
| ***F25D 17/04*** | (2006.01) |
| *F25D 29/00* | (2006.01) |
| *F25D 21/04* | (2006.01) |

(52) U.S. Cl.

CPC ..... *F25D 17/005* (2013.01); *F25D 17/045* (2013.01); *F25D 17/047* (2013.01); *F25D 27/00* (2013.01); *F25D 13/00* (2013.01); *F25D 21/04* (2013.01); *F25D 29/005* (2013.01)

(58) Field of Classification Search

CPC ..... F25D 27/00; F25D 2327/00; F25D 17/04; F25D 17/047; F25D 17/042; F25D 17/045; F25D 17/005; F25D 13/00

USPC ..... 454/272–273, 293, 322, 248, 294, 295

See application file for complete search history.

(56) References Cited

U.S. PATENT DOCUMENTS

| | | | | |
|---|---|---|---|---|
| 3,692,977 A * | 9/1972 | Duhamel | F24F 7/06 392/347 |
| 2015/0036355 A1* | 2/2015 | Mitchell | F21V 29/15 362/311.02 |
| 2016/0161669 A1* | 6/2016 | Lee | F25D 27/00 362/621 |
| 2016/0313051 A1* | 10/2016 | Alt | F21V 33/0012 |

* cited by examiner

*Primary Examiner* — Steven B McAllister
*Assistant Examiner* — Ko-Wei Lin
(74) *Attorney, Agent, or Firm* — Baker Donelson

(57) ABSTRACT

A combination light and pressure relief vent (10) is disclosed which includes a housing (11), a valve assembly (12), and a light assembly (13). The housing include a valve body (16), port tube (17), and an outside louver (18). The valve body has a low pressure intake port (25), a high pressure intake port (26), and a low pressure exhaust port (27). The valve assembly includes a low pressure intake valve (40), a high pressure intake valve (42), and a low pressure exhaust valve (44). The light assembly includes a heat sink casing (51) which partially defines a heat chamber (52). The casing has a front wall (55) to which is mounted an LED module (57). A lens cover (61) is coupled to the front surface of the casing. Heat generated by the LED module is transferred through the casing to the heat chamber to warm the valve assembly.

8 Claims, 2 Drawing Sheets

COLD ROOM COMBINATION VENT AND LIGHT

REFERENCE TO RELATED APPLICATION

This is a continuation-in-part application of U.S. patent application Ser. No. 15/060,655 filed Mar. 4, 2016 and entitled "COLD ROOM COMBINATION VENT AND LIGHT".

TECHNICAL FIELD

This invention relates to pressure relief vent used on temperature controlled enclosures such as walk-in freezers and test chambers.

BACKGROUND OF THE INVENTION

Many temperature controlled commercial enclosed spaces need to be equipped with pressure relief ports or vents which are sometimes referred to as ventilators or ventilator ports. This is particularly true where the sealed space is subjected to temperature related gas volume variations that must be relieved.

Cold rooms typically have a neutral air pressure. To achieve the neutral air pressure passive ports are suitable for these enclosures. However existing passive pressure relief ports, meaning those without fans or blowers, have often permitted air migration where there is no significant pressure differential. With walk-in freezers this causes undesirable condensation and frosting. Frosting is a substantial problem that occurs as ambient warm air drawn into a low temperature chamber releases significant amounts of moisture relative to the change in dew point of the air at high and low temperatures. Air is drawn through the port after each door opening cycle as the warm air that entered the enclosure cools and contracts. If venting does not occur, a partial vacuum results which make it difficult to reopen the door. In extreme cases, the enclosures can even collapse.

A temperature rise in the enclosure between cooling cycles, and especially during a defrost cycle, creates a need to vent air to prevent pressure buildup. Again, failure to vent this pressure, with adequate relief capacity, can cause the chamber to rupture.

Passive pressure relief ports are in wide commercial use today. Large structures require the movement of a large amount of air to equalize the pressure between the inside and the outside of the enclosure. Existing vents can be either of a large size or a gang of small sized vents. This large amount of air carries with it a large amount of moisture. This moisture can condense almost immediately upon contact with the cold air and cold surfaces of the enclosure. If this occurs, a large ice block may form on the interior wall, which may eventually block the inflow of air through the port. This large ice block may also pose a potential danger to someone should it fall from the wall.

Another problem with cold rooms is that high negative pressure may be dangerous as the warm air entering the cold room enters with the entrance of a person. This warm air subsequently cools and creates a negative pressure within the cold room. This negative pressure may hold the door in a closed position until the room normalizes. A person within the cold room may become panicked when unable to open the door. Today's vents alleviate small amounts of incoming warm air, but are inadequate to deal with large volumes of warm air associated with multiple door entries or large sliding doors.

Yet another problem is the icing of certain valves associated with vents of cold rooms. Moisture entering the cold room may condense as ice upon the valves, thereby preventing them from opening properly. One solution to this problem has been to simply chip the ice off the valve or remove it with the use of a heat gun. These solutions are time consuming and inadequate as it may damage the vent, cause bodily injury, and be only effective once the problem is discovered. As such, some vents have included resistive heaters. However, should the heater fail the problem will go unresolved until the heat is repaired.

Accordingly, it is seen that a need exists for a pressure release vent that prevents the formation of ice thereon. It thus is to be provision of such a pressure relief port that the present invention is primarily directed

SUMMARY OF THE INVENTION

In a preferred form of the invention a combination cold room light and vent comprises a housing defining a heat chamber, at least one air control valve coupled to the housing heat chamber, and a light source coupled to the housing heat chamber, the light source being in thermal communication with the at least one air control valve through the heat chamber. With this construction, heat generated by the light source warms the at least one air control valve.

DETAILED DESCRIPTION

Figure 1:
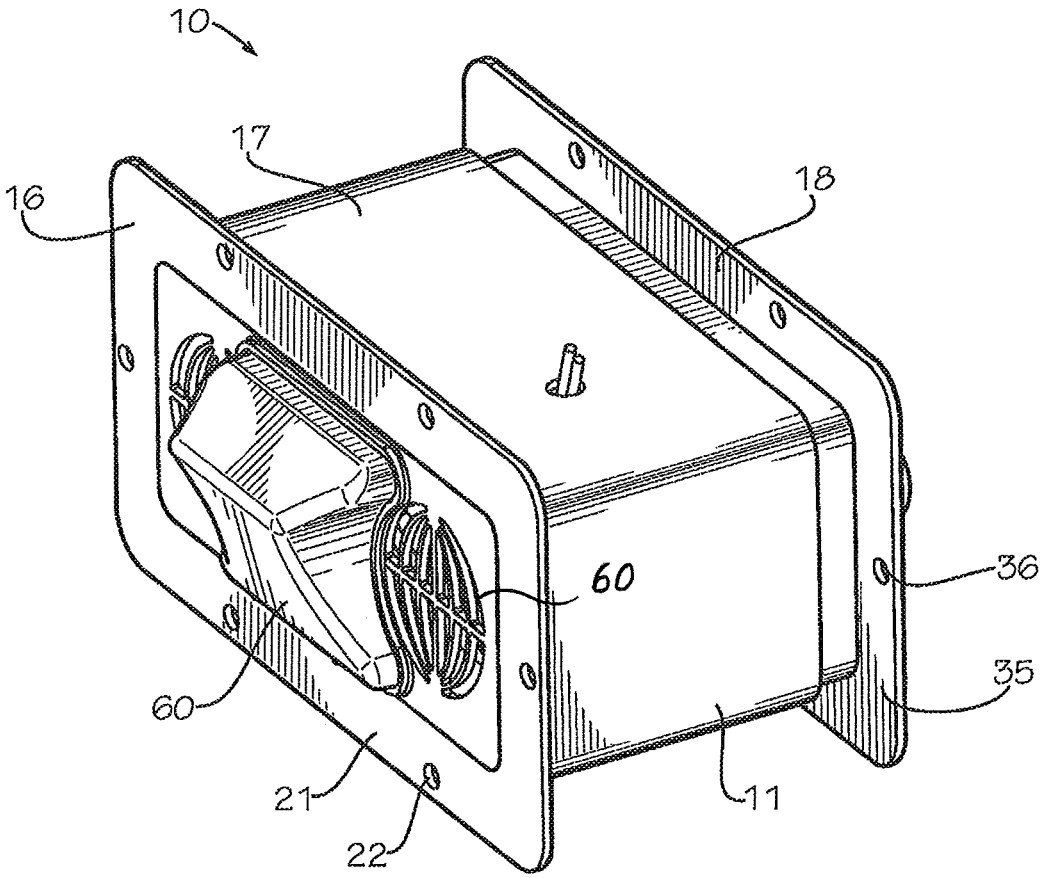
FIG. 1 is a perspective view of a cold room vent and light that embodies principles of the invention in its preferred form.
Figure 3:
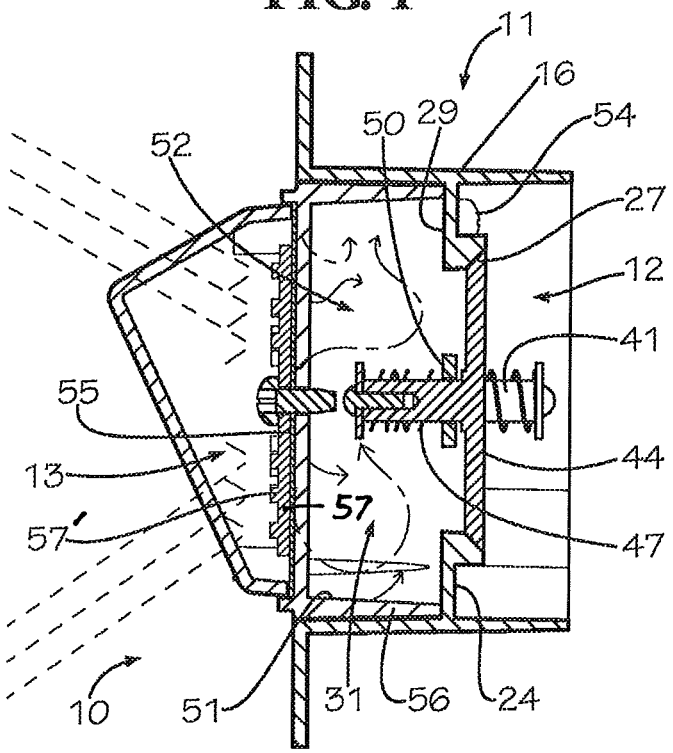
FIG. 3 is a cross-sectional view of the cold room vent and light of FIG. 1.
Figure 2:
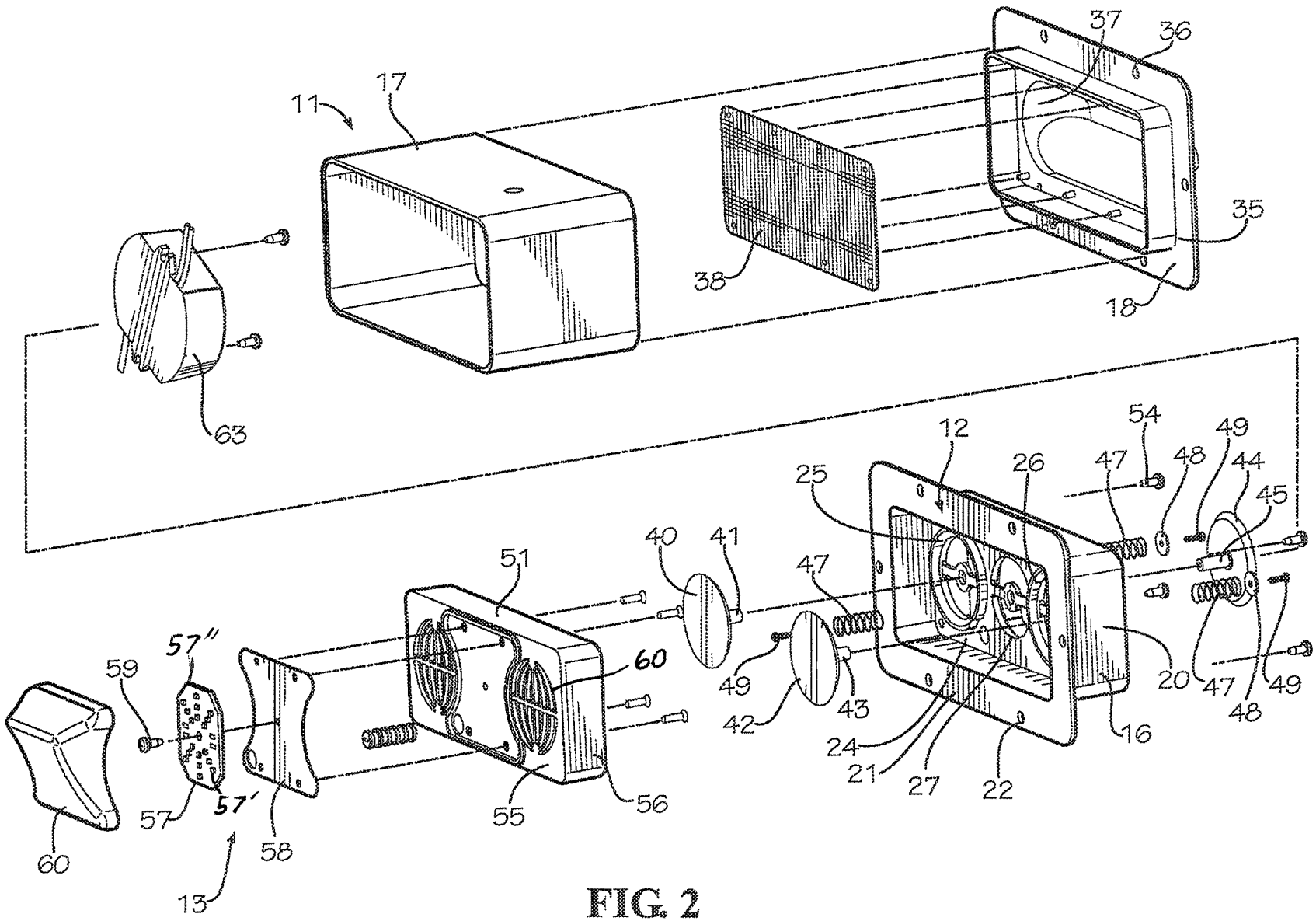
FIG. 2 is an exploded, perspective view of the cold room vent and light of FIG. 1.

With reference next to the drawings, there is shown a combination light and pressure relief ventilator or vent 10 in a preferred form of the invention, referred to hereinafter simply as vent. The vent 10 is used with a temperature controlled enclosure, such as a freezer, refrigerator or other cold room, all of which are referred collectively herein as cold room.

The vent 10 includes a housing 11, a valve assembly 12, and a light assembly 13. The housing 11 includes a thermal valve body 16, a tubular port tube 17, and an outside louver 18. The housing 11 is typically mounted to the wall of the cold room with the valve body 16 mounted to the inside surface and the outside louver 18 mounted to the outside surface. The housing 11 is typically made of a plastic material or the like.

The valve body 16 is generally rectangular in shape with a central tube portion 20 and an outwardly extending peripheral mounting flange 21 with flange mounting holes 22 therein through which mounting screws are passed to couple the valve body to the inside surface of the cold room. The valve body 16 has and interior stop wall 24 which has a low pressure intake port 25, a high pressure intake port 26, and a low pressure exhaust port 27. The interior stop wall is positioned inwardly from the front surface 29, including the peripheral mounting flange 21, so as to define an interior chamber 31. Each port 25, 26 and 27 has a central bar 32 with a valve mounting hole 33 therein.

The valve body 16 central tube portion 20 is configured to telescopically mate with port tube 17 which extends through the interior of the cold room walls. The port tube 17 is telescopically coupled at an opposite end to the outside louver 18.

The outside louver 18 has an outwardly extending mounting flange 35 with mounting holes 36 therein through which mounting screws extend to couple the louver 18 to the outside surface of the cold room. The louver 18 includes a drip deflecting hood 37 and a screen 38 therein to prevent the entrance of dirt, foreign object, insects or other pests.

The valve assembly 12 is coupled to and may be considered to be a portion of the valve body 16. The valve assembly 12 includes a low pressure intake valve 40 having a mounting stem 41 extending through the valve mounting hole 33 of the low pressure intake port 25, a high pressure intake valve 42 having a mounting stem 43 extending through the valve mounting hole 33 of the high pressure intake port 26, and a low pressure exhaust valve 44 having a mounting stem 45 extending through the valve mounting hole 33 of the low pressure exhaust port 27. Valves 40, 42 and 44 are all considered to be air flow control valves. The end of the stem of each valve 40, 42 and 44 is coupled to a spring 47, washer 48 and push in stud 49 which bias each valve towards a closed position. Each spring 47 resides within a spring seat or pocket 50 which holds the spring in place. Each spring 47 is configured to allow the valve to move from a closed position to an open position against the biasing force of the spring 47, as explained in more detail hereinafter.

The low pressure intake valve 40 and the high pressure intake valve 42 each have the same size and configuration. However, the valve mounting hole pocket 50 of the low pressure intake valve 40 is configured to be deeper than the pocket 50, or positioned farther from the end of the stem, of the high pressure intake valve 42 so that the associated spring 47 of the low pressure intake valve 40 is less compressed than that of the high pressure intake valve. This difference in spring compressions allows the valves 40 and 42 to be the same construction to aid in manufacturing, inventory and installation, yet allows for different opening pressures for each, i.e., the low pressure intake valve 40 opens first due to the spring compression being less than that of the high pressure intake valve 42.

The light assembly 13 includes a rectangular box shaped LED heat sink] casing 51 which is configured to telescopically fit within the interior chamber 31 of the valve body 16, so as to enclosure and thereby form a heat chamber 52 through the combination of the casing 51 and valve body 16. The casing is preferably made of a thick heat conductive metal, such as aluminum. The thickness of the casing is such that it retains heat and slowly releases the retained heat over time. The casing 51 is maintained in position by casing mounting screws 54. The casing 51 has a front wall or surface 55, to which is flushly mounted an LED module 57 containing a plurality of LED diodes 57' mounted to an LED backing or board 57", and four peripheral sidewalls 56. The front wall 55 includes two airflow opening arrangements 60 made of multiple small openings (shown similarly shaped to a world globe) therethrough which allow for the passage of air through the front wall 55 and into the interior space of the casing 51. A combination lens gasket and LED thermally conductive pad is position between the LED module 57 and the front surface 55 of the casing 51. The LED module board 57" is mounted flush against the conductive pad 58, which in turn is mounted flush against the front wall 55 to provide a maximum transfer of heat from the LED diodes 57' through the LED board 57", through the conductive pad 58, and finally to the front wall 55. The LED module and pad are held in position through a mounting screw 59. A transparent or translucent lens or lens cover 61 is coupled to the front surface 55 of the casing to cover the LED module 57 through lens cover mounting screws 61. An LED driver 63 is electrically coupled to the LED module 57. The LED driver 63 is positioned within the housing 11 and coupled to a source of electric current, such as a conventional A.C. line.

In use, the vent 10 is mounted to the wall of a cold room with the valve body mounted to the interior surface and the outside louver mounted to the exterior surface of the cold room wall. The vent 10 allows for an asymmetrical, dual stage venting of pressure within the cold room. Should the cold room door be opened and a small amount of air is introduced into the cold room (small volume), the low pressure intake valve 40 overcomes the biasing force of its spring 47 to move to an open position. The opening of the low pressure intake valve 40 allows the entrance, flow, or passage of a small volume of air into the cold room to offset the condensing of the small volume of warm air which creates a negative pressure. The low pressure intake valve 40 opens at a negative pressure level of approximately 0.4 inches of water. The valve allows a flow rate of 10 CFM at 0.5 inches of water.

Should the cold room door be opened and a large amount of air is introduced into the cold room (high volume), both the low pressure intake valve 40 and the high pressure intake valve 42 overcome the biasing forces of their springs 47 to each move to their open positions. The opening of both the low pressure intake valve 40 and the high pressure intake valve 42 allows the entrance or passage of a large volume of air into the cold room in a very fast manner to offset the condensing of the large volume of warm air which creates a large negative pressure. The high pressure intake valve 42 may be thought of as a second stage valve in the event when a large amount of air is needed to be taken in to relieve the pressure within the cold room. The process commences with the low pressure intake valve 40 opening as previously described. The high pressure intake valve 42 then opens at a negative pressure level of approximately 0.7 inches of water. The high pressure intake valve allows a flow rate of 30 CFM at 1.0 inches of water. The quick equalization of the pressure through the opening of both valves prevents the cold room door from being stuck closed due to negative pressure within the cold room, which minimizes the potential of one panicking due to the inability to temporarily open the door.

It should be noted that each airflow opening arrangement 60 is laterally aligned directly with an air intake port 25 and 26. As such, the excess air within the cold room passes through the airflow opening arrangement 60 immediately prior to passing through the air intake port 25 and 26. As such, the air passing through the air intake ports 25 and 26 is provided with warmth from the heat sink front wall 55 to maximize the warmth applied to the air intake ports and their respective valves. It should also be noted that the airflow opening arrangement 53 is made of multiple small openings so that heat sink material is located between adjacent openings to provide a greater amount of surface area through which to transfer heat from the heat sink to the air passing through the airflow opening arrangement 53.

As the room equalizes from the experience of negative pressure, the high pressure intake valve 42 will first return to its seated position once the air pressure returns to a level below approximately 0.7 inches of water. The air pressure within the cold room continues to drop by air passing through the low pressure intake valve 40, until the pressure reaches approximately 0.4 inches of water wherein the low pressure intake valve 40 will also move to its closed position. The end results is a cold room which is generally at a neutral pressure.

The exhaust valve 44 overcomes the biasing force of its spring 47 when positive pressure exists within the cold room. The exhaust valve 44 opens at a positive pressure level of less than 0.6 inches of water. The exhaust valve allows a flow rate of 10 CFM at 0.5 inches of water. The cold room may experience positive pressure when one slams a door shut or when the air therein warms, such as when the cold room is going through a defrost mode. This positive pressure may prevent the full closing of the refrigerator door.

Thus, the flow or venting of air into the cold room is controlled by at least two valves while the flow of air out of the cold room is controlled by a single valve, all valves being the same size. This arrangement provides for an asymmetric flow of air into the cold room which is approximately twice the amount as the flow out of the cold room. Of course, the number of valves or their sizes may also be different so long as the valve controlled flow into the cold room is much greater than the valve controlled flow out of the cold room.

The vent is preferably designed so that the LED module 57 is always energized to provide constant light within the cold room. The use of LED lights facilitates this due to their low power consumption. The heat generated by the constantly illuminated LED module 57 thermally passes through the thermal pad 58 to the LED heat sink casing 51, i.e., the LED module is in thermal communication with the LED heat sink casing 51. This heating of the LED heat sink casing 51 constantly warms the air within the interior chamber 31 of the valve body 16 and thus warms the intake valves 40 and 42 and exhaust valve 44. The warming of the valves prevents the formation of ice upon the valves which would prevent them from properly opening or closing, i.e., prevents the valves from freezing in place within their respective ports. It should be noted that this heating is economical as the cold room should be constantly illuminated regardless.

It should be understood that the combination of a light and vent also reduces cost and labor as both features are achieved through the mounting of a single unit which includes both functions.

It should be understood that the difference in spring compressions may also be achieved through the use of different sized springs, different valve stem lengths, the addition of a spacer to compress the spring, or any other method of achieving different compression forces associated with the springs.

The term "heat sink" and "heat sink casing" is intended to mean a structure which absorbs excess or unwanted heat and subsequently slowly releases the absorbed heat so that the released heat may be used for a prolong period of time as a heat source. This definition is not intended to include all material which simply conduct heat, such as thin sheets of metal or other materials through which heat readily passes, such as thin sheets of aluminum, stainless steel, tin or other similar metals, which may be used in the construction of light fixture housings, mounting boxes, or the like.

As an alternative to the LED thermally conductive pad, a thermal grease may be utilized between the LED board and front wall of the heat sink. The thermal grease may be any conventionally known thermal grease, and may be composed of a polymerizable liquid matrix and large volume fractions of electrically insulating, but thermally conductive filler. Typical matrix materials are epoxies silicones, urethanes, and acrylates; solvent-based systems, hot-melt adhesives, and pressure-sensitive adhesive tapes are also available. Aluminum oxide, boron nitride, zinc oxide, and increasingly aluminum nitride are used as fillers for these types of adhesives. The filler loading can be as high as 70-80% by mass, and raises the thermal conductivity of the base matrix from 0.17-0.3 W/(m·K) (watts per meter-kelvin) up to about 2 W/(m·K). As such, the term conductive pad includes pads made of a non-solidified material, paste, or the like.

The heat chamber 52 is enclosed except for the airflow openings 56 and the valves 40, 42, and 44. The enclosing of the heat chamber provides for the maximum capturing of the heat produced by the LED diodes which is transferred to the heat sink casing front wall 55.

The present invention provides for conducting heat from the LED module directly to the front wall of the heat sink casing. This conduction of heat provides for better heat transfer to the heat sink/heat sink casing. The conduction of heat is different from prior art devices which utilized the heat from an incandescent bulb to heat other components through convection, i.e., the bulb heats the air surrounding the bulb which is then passed to other components. It has been found that the conduction of heat provides for a more efficient and steady heat transfer as compared to heat transfer through convention.

It thus is seen that a vent is now provided which avoids the formation of ice on the vent valves and allows for both small and large amounts of air venting. Though it has been described in detail in its preferred form, it should be realized that many modifications, additions and deletions may be made without departure from the spirit and scope of the invention as set forth in the following claims.

The invention claimed is:

1. A combination cold room light and vent comprising:

a housing;

a heat sink casing coupled to said housing, the combination of said housing and said heat sink casing defining a heat chamber;

an air control valve coupled to said housing, said air control valve being in thermal communication with said heat chamber, wherein said air control valve is a first pressure air control intake valve, and further comprising a second pressure air control intake valve, wherein said first pressure air control valve is activated at a lower air pressure than said second pressure air control intake valve, and an LED module light source thermally coupled to said heat sink casing to transfer heat through conduction to said heat sink casing to heat said heat chamber to warm said air control valve, whereby heat generated by the LED module light source warms the heat sink casing, thereby warming the heat chamber so as to warm the air control valve.

2. The combination cold room light and vent of claim 1 wherein said heat sink casing is tubular, and wherein said housing is configured to telescopically receive said tubular heat sink casing therein.

3. The combination cold room light and vent of claim 2 wherein said tubular heat sink casing includes a heat sink casing front wall and peripheral sidewalls extending from said front wall.

4. The combination cold room light and vent of claim 1 wherein said heat sink casing has a front wall with at least one airflow opening therethrough, said heat chamber being enclosed except for said at least one airflow opening extending through said front wall and said air control valve.

5. The combination cold room light and vent of claim 4 wherein said airflow opening is laterally aligned with said first pressure air control intake valve.

6. The combination cold room light and vent of claim 4 wherein said airflow opening is comprised of a group of openings extending through said front wall.

7. The combination cold room light and vent of claim 4 wherein said airflow opening includes two airflow openings, and wherein each said airflow opening is laterally aligned with one said air control intake valve.

8. The combination cold room light and vent of claim 1 further comprising a thermally conductive pad positioned between said LED module light source and said heat sink casing.

* * * * *